US009058720B2

(12) United States Patent
Gangadharan et al.

(10) Patent No.: US 9,058,720 B2
(45) Date of Patent: Jun. 16, 2015

(54) LOGIN APPLICATION FOR A WAGERING GAME PORTAL

(75) Inventors: Magesh Gangadharan, Des Plaines, IL (US); Mark B. Gagner, West Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 275 days.

(21) Appl. No.: 13/295,853

(22) Filed: Nov. 14, 2011

(65) Prior Publication Data

US 2012/0122567 A1 May 17, 2012

Related U.S. Application Data

(60) Provisional application No. 61/413,476, filed on Nov. 14, 2010.

(51) Int. Cl.
*G07F 17/32* (2006.01)

(52) U.S. Cl.
CPC ..... *G07F 17/3223* (2013.01); *G07F 17/3239* (2013.01); *G07F 17/3241* (2013.01)

(58) Field of Classification Search
CPC .. G06Q 40/02; H04L 67/108; H04L 63/0428; G06F 21/10; G06F 21/105
USPC ..... 463/29, 42; 473/409; 726/31; 717/101; 1/1; 715/246
See application file for complete search history.

(56) References Cited

U.S. PATENT DOCUMENTS

| | | | | |
|---|---|---|---|---|
| 6,508,709 | B1 * | 1/2003 | Karmarkar | 463/42 |
| 7,047,241 | B1 * | 5/2006 | Erickson | 1/1 |
| 2006/0195816 | A1 * | 8/2006 | Grandcolas et al. | 717/101 |
| 2007/0006327 | A1 * | 1/2007 | Lal et al. | 726/31 |
| 2008/0098301 | A1 * | 4/2008 | Black et al. | 715/246 |
| 2008/0108456 | A1 * | 5/2008 | Bonito | 473/409 |
| 2011/0098108 | A1 * | 4/2011 | Kuper et al. | 463/29 |

* cited by examiner

*Primary Examiner* — Masud Ahmed
(74) *Attorney, Agent, or Firm* — Nixon Peabody LLP

(57) ABSTRACT

Systems described herein include wagering game systems having a portal container with one or more portal applications running within the portal container. The portal container includes a login application that receives player credentials and logs into various servers using the login credentials. The login application serves as a proxy for the portal applications that communicate with the servers.

29 Claims, 6 Drawing Sheets

LOGIN APPLICATION FOR A WAGERING GAME PORTAL

CROSS-REFERENCE TO RELATED PATENT DOCUMENTS

This patent application claims the benefit of priority, under 35 U.S.C. Section 119(e), to Gangadharan U.S. Provisional Patent Application Ser. No. 61/413,476, entitled "LOGIN APPLICATION FOR A WAGERING GAME PORTAL," filed on Nov. 14, 2010, which is incorporated by reference in its entirety.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2010, WMS Gaming, Inc.

FIELD

Embodiments of the inventive subject matter relate generally to wagering game systems, and more particularly to login applications for a portal operating on a wagering game system.

BACKGROUND

Wagering game machine makers continually provide new and entertaining games. One way of increasing entertainment value associated with casino-style wagering games (e.g., video slots, video poker, video black jack, and the like) includes offering a variety of base games and bonus events. However, despite the variety of base games and bonus events, players often lose interest in repetitive wagering gaming content. In order to maintain player interest, wagering game machine makers frequently update wagering game content with new game themes, game settings, bonus events, game software, and other electronic data and in addition, provide services to the player through the wagering game machine.

In some cases, these new games and services are provided as applications on the wagering game machine. The applications may need to communicate with various servers. The proliferation of applications can lead to numerous connections to various servers, requiring resources dedicated to supporting the numerous applications and connections.

BRIEF DESCRIPTION OF THE FIGURES

Embodiments of the invention are illustrated by way of example and not limitation in the Figures of the accompanying drawings in which.

DESCRIPTION OF THE EMBODIMENTS

The following detailed description refers to the accompanying drawings that depict various details of examples selected to show how the present invention may be practiced. The discussion addresses various examples of the inventive subject matter at least partially in reference to these drawings, and describes the depicted embodiments in sufficient detail to enable those skilled in the art to practice the invention. Many other embodiments may be utilized for practicing the inventive subject matter other than the illustrative examples discussed herein, and many structural and operational changes in addition to the alternatives specifically discussed herein may be made without departing from the scope of the inventive subject matter.

In this description, references to "one embodiment" or "an embodiment," or to "one example" or "an example" are not intended necessarily to refer to the same embodiment or example; however, neither are such embodiments mutually exclusive, unless so stated or as will be readily apparent to those of ordinary skill in the art having the benefit of this disclosure. Thus, the present invention can include a variety of combinations and/or integrations of the embodiments and examples described herein, as well as further embodiments and examples as defined within the scope of all claims based on this disclosure, as well as all legal equivalents of such claims.

Example Wagering Game Machine

Figure 1:
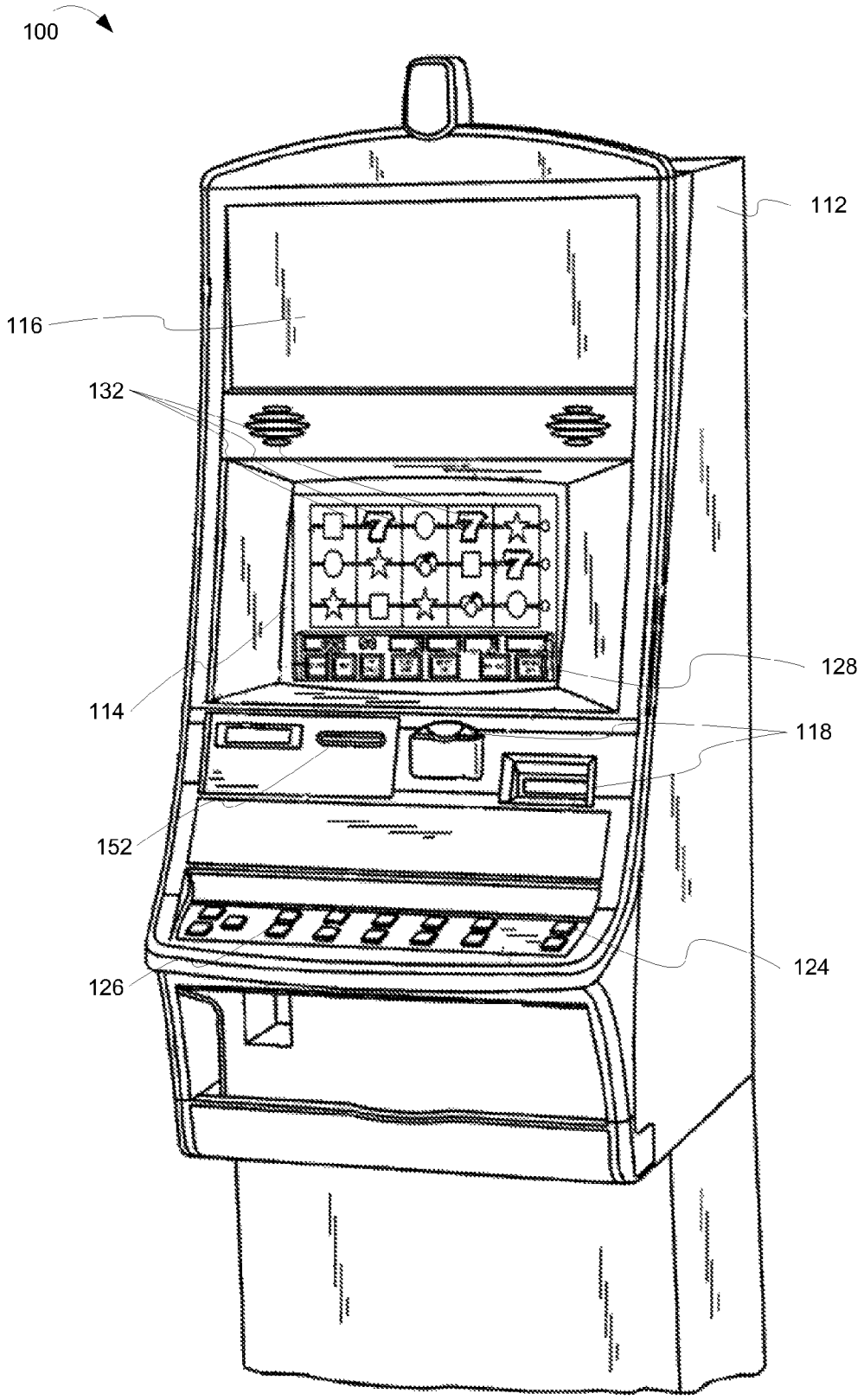
FIG. 1 is a perspective view of an example wagering game machine, in which embodiments of the invention operate.

FIG. 1 is a perspective view of a wagering game machine, according to example embodiments of the invention. Referring to FIG. 1, a wagering game machine 100 is used in gaming establishments, such as casinos. According to embodiments, the wagering game machine 100 can be any type of wagering game machine and can have varying structures and methods of operation. For example, the wagering game machine 100 can be an electromechanical wagering game machine configured to play mechanical slots, or it can be an electronic wagering game machine configured to play video casino games, such as blackjack, slots, keno, poker, blackjack, roulette, etc.

The wagering game machine 100 comprises a housing 112 and includes input devices, including value input devices 118 and a player input device 124. For output, the wagering game machine 100 includes a primary display 114 for displaying information about a basic wagering game. The primary display 114 can also display information about a bonus wagering game and a progressive wagering game. The wagering game machine 100 also includes a secondary display 116 for displaying wagering game events, wagering game outcomes, and/or signage information. While some components of the wagering game machine 100 are described herein, numerous other elements can exist and can be used in any number or combination to create varying forms of the wagering game machine 100.

The value input devices 118 can take any suitable form and can be located on the front of the housing 112. The value input devices 118 can receive currency and/or credits inserted by a player. The value input devices 118 can include coin acceptors for receiving coin currency and bill acceptors for receiving paper currency. Furthermore, the value input devices 118 can include ticket readers or barcode scanners for reading information stored on vouchers, cards, or other tangible portable storage devices. The vouchers or cards can authorize access to central accounts, which can transfer money to the wagering game machine 100.

The player input device 124 comprises a plurality of push buttons on a button panel 126 for operating the wagering game machine 100. In addition, or alternatively, the player input device 124 can comprise a touch screen 128 mounted over the primary display 114 and/or secondary display 116.

The various components of the wagering game machine 100 can be connected directly to, or contained within, the housing 112. Alternatively, some of the wagering game machine's components can be located outside of the housing 112, while being communicatively coupled with the wagering game machine 100 using any suitable wired or wireless communication technology.

The operation of the basic wagering game can be displayed to the player on the primary display 114. The primary display 114 can also display a bonus game associated with the basic wagering game. The primary display 114 can include a cathode ray tube (CRT), a high resolution liquid crystal display (LCD), a plasma display, light emitting diodes (LEDs), or any other type of display suitable for use in the wagering game machine 100. Alternatively, the primary display 114 can include a number of mechanical reels to display the outcome. In FIG. 1, the wagering game machine 100 is an "upright" version in which the primary display 114 is oriented vertically relative to the player. Alternatively, the wagering game machine can be a "slant-top" version in which the primary display 114 is slanted at about a thirty-degree angle toward the player of the wagering game machine 100. In yet another embodiment, the wagering game machine 100 can exhibit any suitable form factor, such as a free standing model, bartop model, mobile handheld model, or workstation console model.

A player begins playing a basic wagering game by making a wager via the value input device 118. The player can initiate play by using the player input device's buttons or touch screen 128. The basic game can include arranging a plurality of symbols along a payline 132, which indicates one or more outcomes of the basic game. Such outcomes can be randomly selected in response to player input. At least one of the outcomes, which can include any variation or combination of symbols, can trigger a bonus game.

In some embodiments, the wagering game machine 100 can also include an information reader 152, which can include a card reader, ticket reader, bar code scanner, RFID transceiver, or computer readable storage medium interface. In some embodiments, the information reader 152 can be used to award complimentary services, restore game assets, track player habits, etc.

Figure 2:
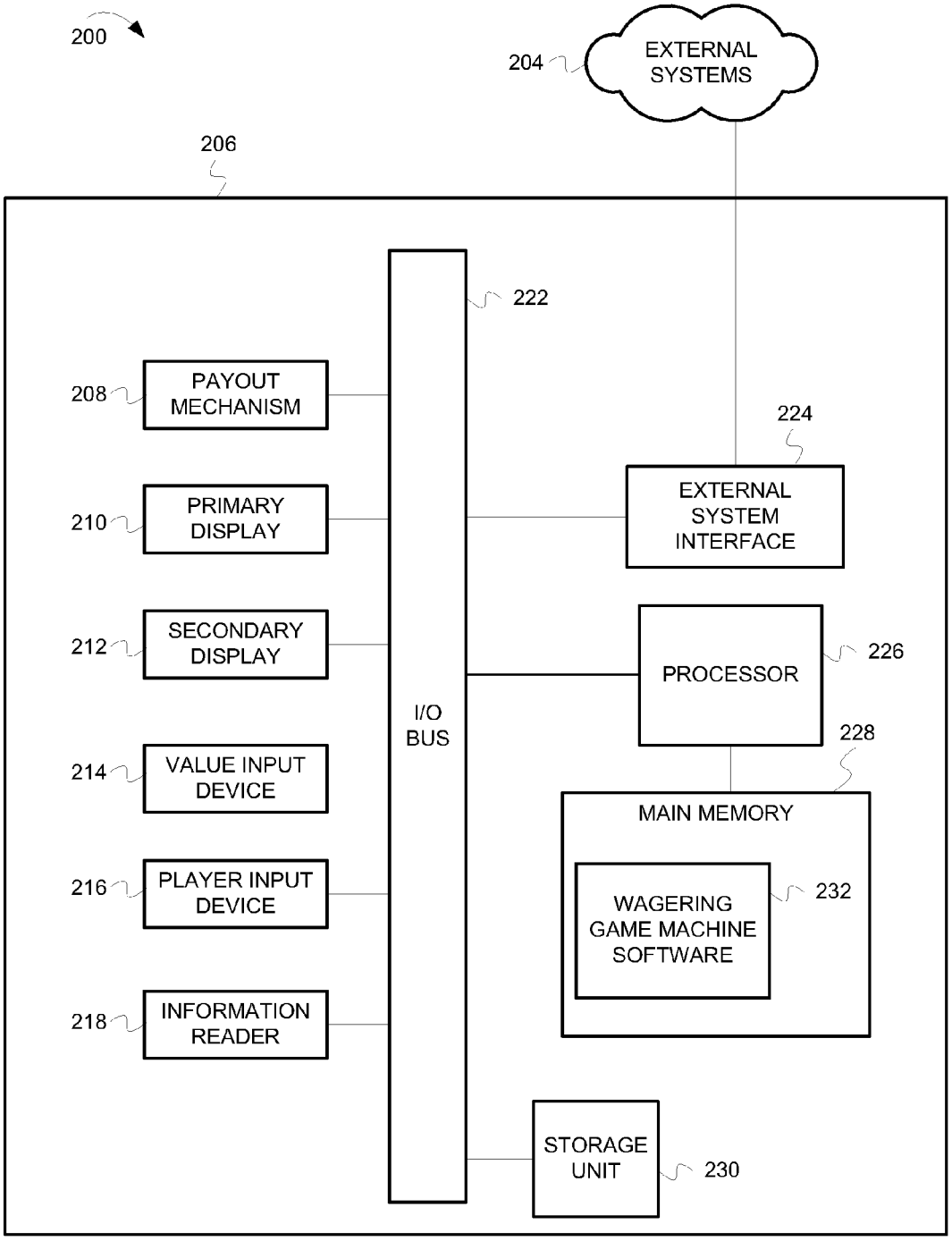
FIG. 2 is a block diagram illustrating a wagering game machine architecture, including a control system, according to example embodiments of the invention.

FIG. 2 is a block diagram illustrating an example wagering game machine architecture 206, including a control system, according to example embodiments of the invention. As shown in FIG. 2, the wagering game machine 206 includes a processor 226 connected to system memory 228, which includes wagering game software 232. In one embodiment, the wagering game presentation software 232 can present wagering games, such as video poker, video black jack, video slots, video lottery, etc., in whole or part. Further, the wagering game software 232 may include a portal container and portal applications as further described below.

In this example configuration, processor 226 is also connected to an input/output (I/O) bus 222, which facilitates communication between the wagering game machine's additional components. It should be clearly understood that many wagering game machines will not include all of the described components; and that components need not be connected through a single bus, or through a bus at all. In this illustrative example, I/O bus 222 is connected to a payout mechanism 208, primary display 210, secondary display 212, value input device 214, player input device 216, information reader 218, and storage unit 230. The player input device 216 can include the value input device 214 to the extent the player input device 216 is used to place wagers. The I/O bus 222 is also connected to an external system interface 224, which is connected to external systems 204 (e.g., wagering game networks).

When present, the value input device 214 can include, for example, a reader configured to receive credit from a stored-value card (e.g., casino card, smart card, debit card, credit card, etc.) inserted by a player. The value input device 214 can also comprise a sensor (e.g., an RF sensor) configured to sense a signal (e.g., an RF signal) output by a transmitter (e.g., an RF transmitter) carried by a player. The value input device 214 can also or alternatively include a ticket reader, or barcode scanner, for reading information stored on a credit ticket, a card, or other tangible portable credit or funds storage device. The credit ticket or card can also authorize access to a central account, which can transfer money to the wagering game machine 206. Still other value input devices 214 can require the use of touch keys on the touch screen. Upon entry of player identification information and, preferably, secondary authorization information (e.g., a password, PIN number, stored value card number, predefined key sequences, etc.), the player can be permitted to access a player's account. As one potential optional security feature, the wagering game machine 206 can be configured to permit a player to only access an account the player has specifically set up for the wagering game machine 206. Other conventional security features can also be utilized to, for example, prevent unauthorized access to a player's account, to minimize an impact of any unauthorized access to a player's account, or to prevent unauthorized access to any personal information or funds temporarily stored on the wagering game machine 206.

The player input device 216 can include the value input device 214 to the extent the player input device 216 is used to place wagers. Where inputs and/or wagers are received through the touch screen, as described herein, in many example systems, there may be no need for a separate player input device. In some examples, the wagering game machine 206 will include a player information reader 218 that facilitates identification of a player by reading a card with information indicating the player's identity (e.g., reading a player's credit card, player ID card, smart card, etc.). Such player information reader 218 can alternatively, or also, include a bar code scanner, RFID transceiver or computer readable storage medium interface. In one embodiment, the player information reader 218 comprises a biometric sensing device.

In one embodiment, the wagering game machine 206 can include additional peripheral devices and/or more than one of each component shown in FIG. 2. For example, in one embodiment, the wagering game machine 206 can include multiple external system interfaces 224 and multiple processors 226. In one embodiment, any of the components can be integrated or subdivided. Additionally, in one embodiment, the components of the wagering game machine 206 can be interconnected according to any suitable interconnection architecture (e.g., directly connected, hypercube, etc.).

In one embodiment, any of the components of the wagering game machine 206 can include hardware, firmware, and/or software for performing the operations described herein. Machine-readable media includes any mechanism that provides (e.g., stores or transmits) information in a form readable by a machine (e.g., a wagering game machine, computer, etc.). For example, tangible machine-readable storage media (e.g., storage device) includes read only memory (ROM), random access memory (RAM), magnetic disk storage media, optical storage media, flash memory machines, etc. Machine-readable transmission media also includes any media suitable for transmitting software over a network.

Figure 3:
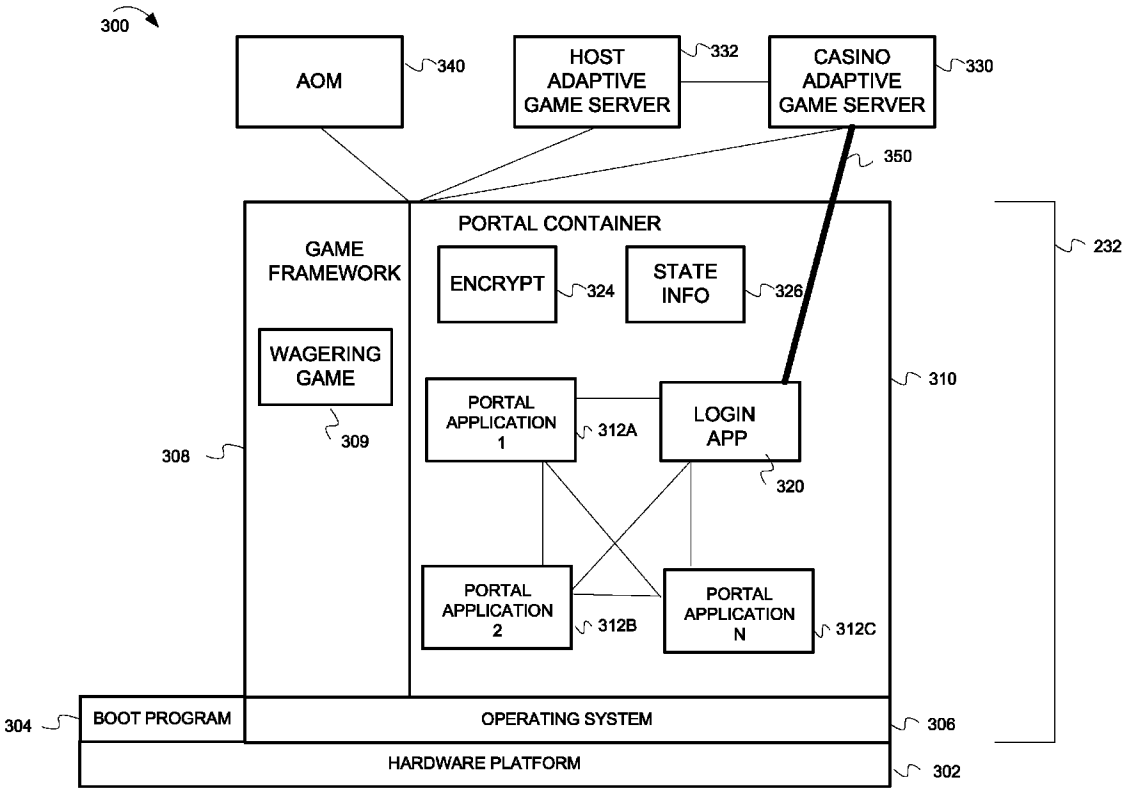
FIG. 3 depicts a block diagram of an example architecture for a wagering game system as described herein.

FIG. 3 is a block diagram illustrating various modules of a system architecture 300 for a wagering game system, according to example embodiments of the inventive subject matter. As shown in FIG. 3, the system architecture 300 includes wagering game machine software 232, portal container 310, a host adaptive game server 332, a casino adaptive game server 330, and an administration, operations and maintenance (AOM) module 340.

Wagering game software 232, in some embodiments, includes a boot program 304, an operating system 306, a game framework 308 that presents a wagering game, and a portal container 310. In various embodiments, the hardware platform executing wagering game software 232 may include a thin-client, thick-client, or some intermediate derivation. The hardware platform may also be configured to provide a virtual client. The boot program 304 may include a basic input/output system (BIOS) or other initialization program that works in conjunction with the operation system 306 to provide a software interface to the hardware platform. The game framework 308 may include standardized game software components either independent or in combination with specialized or customized game software components that are designed for a particular wagering game. The customized components may implement a theme for the wagering game 309. Further, the components may include audio, video, and image data that are used to present theme elements for the wagering game. In one example embodiment, the wagering game framework 308 may include software operative in connection with the hardware platform and operating system 306 to present a wagering game 309 upon which monetary value may be wagered, such as video poker, video black jack, video slots, video lottery, etc., in whole or part. Further, the game framework 308 may include software operative to accept a wager from a player. According to another example embodiment, one or more of the components of game framework 308 may be provided as part of the operating system 306 or other software used in the wagering game system 300 (e.g., libraries, daemons, common services, etc.).

Portal container 310 includes software modules that provide a runtime environment for one or more portal applications 312 and a login application 320. In some embodiments, the portal container includes an Adobe Flash runtime environment provided by Adobe Systems Incorporated of San Jose, California. In alternative embodiments, other runtime environments such as Java or Microsoft Silverlight may be used. The runtime environment provided by portal container 310 includes software interfaces for displaying user interface elements and other graphics on a display such as primary display 114, input interfaces for receiving input from various input devices on the wagering game machine, communications interfaces, and other software interfaces for use by portal applications 312. The runtime environment provided by portal container 310 separate and distinct from those provided by the operating system upon which the portal container executes, although the portal container makes use of functions provided by the operating system.

Portal container 310 provides an environment in which portal applications 312 can present secondary content (e.g., audio and video content) in a multi-windowed presentation format such that the content provided by portal applications 312 is provided in a separate window or windows from the content provided by wagering game 309. In some embodiments, portal applications 312 running in portal container 310 may be provided on an area of displays 114 or 116 that is separate from the display area of wagering game 309. In alternative embodiments, the portal applications 312 in portal container 310 may be presented using a tabbed windowing scheme, in which content associated with the selected tab is presented topmost on display 114 or display 116. The portal container may provide a multiple document interface (MDI) such that a parent window (e.g., a portal container window) maintains multiple windows for portal applications.

Portal container 310 may maintain one or more communications channels with various servers such as the CAG, HAG or other servers as described below. The communications channels may full duplex channels and may be used for communication of message data, transaction data, gaming data or other data.

Portal applications 312 may be any of a number of different applications that provide audio, video or both audio and video content to a wagering game machine user. Further, portal applications 312 may interact with the user using any of the input devices available on the wagering game machine. Examples of such applications include game applications, advertising applications that present ads for various goods and services, messaging applications that provide the capability to exchange messages with another user or users, RSS (Really Simple Syndication) services; social media services, resort or casino service applications that provide the capability to view bills, request amenities, and reserve and purchase tickets for shows, spas, or other services that may be available at a gaming establishment, email applications, web browser applications, or information provider applications (e.g., news, weather, sports, financial etc.). The inventive subject matter is not limited to any particular type of portal application.

During their operation, portal applications may communicate among themselves, with the login application 320, and with servers such as servers 330 and 332.

Login application 320 receives login credentials from a wagering game machine user and provides the login credentials to servers that require authorization and/or authentication prior to using the services available on the server. The login credentials may be a user identification and password combination provided by a user, or the login credentials may be obtained, at least in part from a player tracking system (not shown) when a user inserts a player tracking card. A user may be prompted to enter a personal identification number (PIN) when the player tracking card is detected.

Portal applications 312 and login application 320 may be written using the ActionScript language from Adobe Systems in those embodiments where the runtime environment provided by the portal container includes an Adobe Flash environment. The Java programming language may be used in Java runtime environments.

In some embodiments, portal container 310 includes an encryption module 324 that is used to encrypt the password or PIN prior to sending the login credentials to a server. The encryption may be AES (Advanced Encryption Standard) in some embodiments. Alternative embodiments may use other encryption methodologies. Although shown as part of the run-time environment provided by portal container 310, encryption module 324 may be provided as part of the login application 320.

One or more of portal applications 312 may be part of an adaptive gaming platform, or may use the services of an adaptive gaming platform. An adaptive gaming platform provides wagering games or other content that is customized (i.e.

adapted) for a user. A user's profile, configuration preferences, game states, game progress, game awards and other information may be persistently stored. In some embodiments, host adaptive game (HAG) server 332 provides persistent storage of such information. Further, in some embodiments, a casino adaptive game (CAG) server 330 provides a gateway for wagering game machines in a particular casino or gaming establishment to the services provided by host adaptive game server 332.

Login application 320 establishes a communications stream 350 with a server such as a CAG server 330. The communication stream may be any type of communications stream supported by the underlying operating system 306. In some embodiments, the communications stream is a TCP socket based stream within which XML encoded data is exchanged. Alternatively, named pipes or local sockets may be used as communications streams.

AOM module 340 provides an interface to configure various aspects of a wagering game machine, including wagering game software 232 and aspects of portal container 310 and the portal applications 312 executing within the container.

During operation, the wagering game machine initializes wagering game application 309, portal applications 312, and login application 320. Login application 320 establishes a communications stream with a server and logs in to the server with login credentials provided by a user. In some embodiments, the server may be a HAG server, and the login application may log in to the HAG server via a link through a CAG server. As illustrated in FIG. 3, portal applications 312 may communicate with each other and with login application 320. During the course of their operation, portal applications 312 may desire access to information and services provided on HAG server 332, CAG server 330 or any other server. The login application acts as a proxy for such portal applications with respect to the login credentials. Further, communications of transactions between the portal applications and to the server 332 or 330 is multiplexed through the login application and communications stream 350, thus the login application is a gateway from the portal applications to external servers such as CAG server 330 and HAG server 332. In some embodiments, the communications may be asynchronous. Multiplexing the communications from the portal applications to an external server has the technical advantage of saving resources when compared to configurations in which the portal applications each establish their own communications streams with an external server.

Information regarding the portal applications may be maintained by the portal container in state information 326. For example, the portal applications running within the portal container and the current run state of the portal applications may be maintained. Further, the communications connection status between portal applications and between login application and a server may be maintained in state information 326. Portal 310 may maintain other state information regarding portal applications as well. Such state information may include events that portal applications 312 wish to be notified of.

Further details on the operation of the above systems and components are provided below with reference to FIGS. 4-5.

Example Wagering Game Machine Operations

Figure 4:
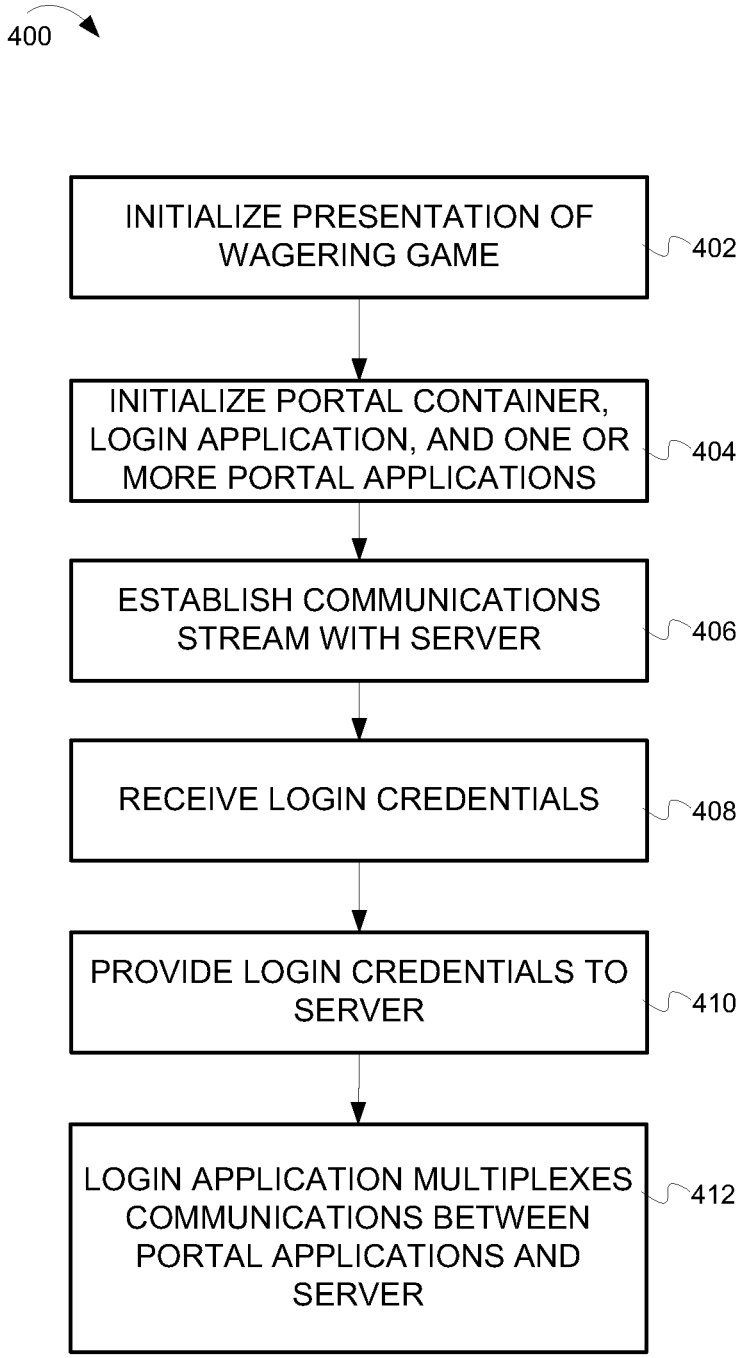
FIGS. 4 and 5 depict flow charts of example methods for operating a wagering game system using a portal container with login and portal applications within the portal container.

FIG. 4 illustrates a flowchart 400 of an example method of operation of a wagering game system including a portal container. The method may begin at block 402 with initializing a wagering game upon which monetary value may be wagered. The wagering game may be initialized as part of the normal startup sequence of the wagering game machine, it may be initialized in response to a request from an AOM, or it may be in response to a user selection or request of a wagering game.

At block 404, the system initializes a portal container, a login application, and one or more portal applications. In some embodiments, AOM 340 communicates with the operating system 306 on the wagering game machine to cause the operating system to load the portal container 310 and any files associated with the portal container. In some embodiments, the portal container reads a configuration that specifies the login application that is to be loaded and which portal applications are to be loaded.

In some embodiments the portal application registers with the portal container. Registration provides information about the portal application to the portal container, at least some of which can be shared with other portal applications running in the portal container.

At block 406 the login application establishes a communications connection with a server such as the CAG server. The connection may be a TCP/socket connection, and XML formatted data may be passed between the login application and the server. In alternative embodiments, a named pipe or local socket connection may be established.

At block 408, the login application receives login credentials for use in authorizing use of a server (e.g,. a CAG server or a HAG server) by a player. The login credentials can be obtained in various ways. For example, upon detecting entry of a player identification card into a card reader such as information reader 218, the reader communicates with a player tracking server. The player tracking server uses information on the player identification card to retrieve information about the player, including a personal identification number (PIN) for the player if the player has registered a PIN with the player tracking server. In some embodiments, the player tracking information is provided to the operating system 306 through a G2S (Game-to-System) protocol, which communicates the information to the login application 320. In alternative embodiments, the player tracking server sends a message to the CAG server, which in turn sends a message to the login application 320. The login application then prompts the user to enter the PIN. Alternatively, the user may be prompted to enter a user name and PIN or user name and password if the user does not provide a player tracking card or of the user cannot be identified from the information on the player tracking card.

At block 410 the PIN or password may be communicated to the CAG server, HAG server or player tracking server for validation and the results of the validation communicated back to the login application. In some embodiments, the PIN or password is encrypted by the login application (for example, using encryption module 324) and the encrypted password or PIN is provided in an XML formatted message before it is communicated to a server. If the PIN or password is valid, the portal applications 312 running within a portal container 310 may be allowed communicate information with a server to send and/or receive information on behalf of a player.

At block 412, one or more portal applications utilize the login credentials provided by the login application to access services provided by the server. The login application can thus act as a proxy for the portal applications. In some embodiments, the portal application accesses a player profile maintained on a server. The profile can be a profile for a casual game (i.e., a non-wagering game) that is accessible on-line (e.g., via the Internet) to a user when the user is not in a gaming establishment. For example, the user may access the casual game from a home computer or from a computer in a hotel room. During play of the casual game, the user may earn achievement tokens (medals, trophies etc.) and may advance to different levels within the casual game. The achievement tokens and levels may be made available to a portal application that logs in to a server maintaining the profile using the login application as a proxy.

Other services may be accessed by a portal application. For example, a message service may be accessed that sends and receives messages using the player identification provided via the login credentials. Messages sent to the player may be received by a portal application and displayed on a window within the portal container. Messages may be sent from the player to others using a user interface provided by the portal application.

Further, the service may comprise a service that notifies the player when a particular wagering game is available for use. For example, the player, in their preference or profile data, may indicate one or more wagering games that the player likes to play. A portal application can query a server such as a HAG server to find out if any of the player's favorite games are available. The availability of the games is then communicated from the server to the portal application, which can display the results to the user. Further, the portal application can notify the user when a favorite game's status changes from unavailable to available.

Figure 5:
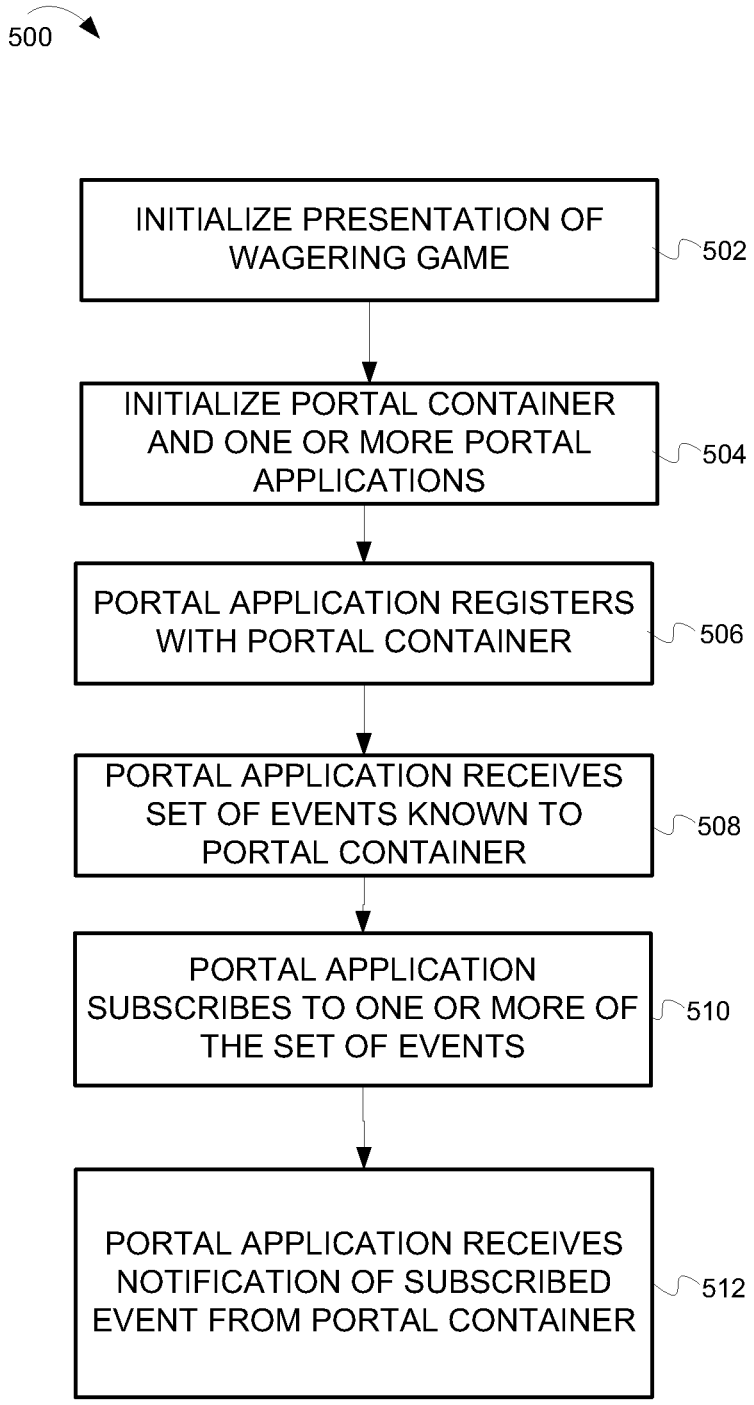

FIG. 5 illustrates a flowchart 500 of an example method of operation of a wagering game system including a portal container. The method may begin at block 502 with initializing a wagering game upon which monetary value may be wagered. Similarly to block 402, the wagering game may be initialized as part of the normal startup sequence of the wagering game machine, it may be initialized in response to a request from an AOM, or it may be in response to a user selection or request of a wagering game.

At block 504, the system initializes a portal container and one or more portal applications. In some embodiments, AOM 340 communicates with the operating system 306 on the wagering game machine to cause the operating system to load the portal container 310 and any files associated with the portal container. In some embodiments, the portal container reads a configuration that specifies which portal applications are to be loaded.

At block 506, the one or more portal application register with the portal container. Registration may include sending information to the portal container about the functionality supported or provided by the portal application. In some embodiments, the portal container maintains state information regarding the portal applications running within the portal container.

At block 508, a portal application receives a set of events supported by the portal container. The supported events may be events that are maintained by the portal container itself, or the events may be events maintained on servers such as a HAG server, CAG server, or any other server in communication with the portal container.

At block 510, the portal application subscribes to a subset of one or more of the set of events supported by the portal container. For example, the portal application may send a message to the portal container providing a list of the events the portal application wishes to subscribe to. Alternatively, the portal application may subscribe to the events individually as needed.

At block 512, the portal application is notified by the portal container that one of the events that the portal container has subscribed to has occurred.

Various events may be supported by the portal container and subscribed to by the portal applications. In some embodiments, an event may be generated when a player inserts or removes a player identification card such as a card used by player tracking systems.

In some embodiments, a login event may indicate that a player has supplied login credentials to the system and that the login credentials were accepted as valid.

In further embodiments, an event may be an event associated with a community based game. A community based game is a game in which multiple players may participate in some aspect of the game such as a bonus round. An event may be generated upon the initiation of a community game, for example, when the bonus round is triggered by one or more players. Further, an event may be generated when a companion player logs into a community based game. Thus a portal application may notify the player if another companion player logs into another wagering game machine that participates in the community based game. A list of companion players that the player is interested in may be maintained as part of the preferences or profile data maintained on a HAG server.

Similar to the casual games described above, a player may earn achievement tokens (medals, trophies etc.) and may advance to different levels within a community based game. A portal application may be notified of events related to the player or the player's companions earning achievement tokens and levels. Further, the event may be a notification of the activities that the player must undertake in order to achieve the next token, milestone, or level.

Example Wagering Game Network

Figure 6:
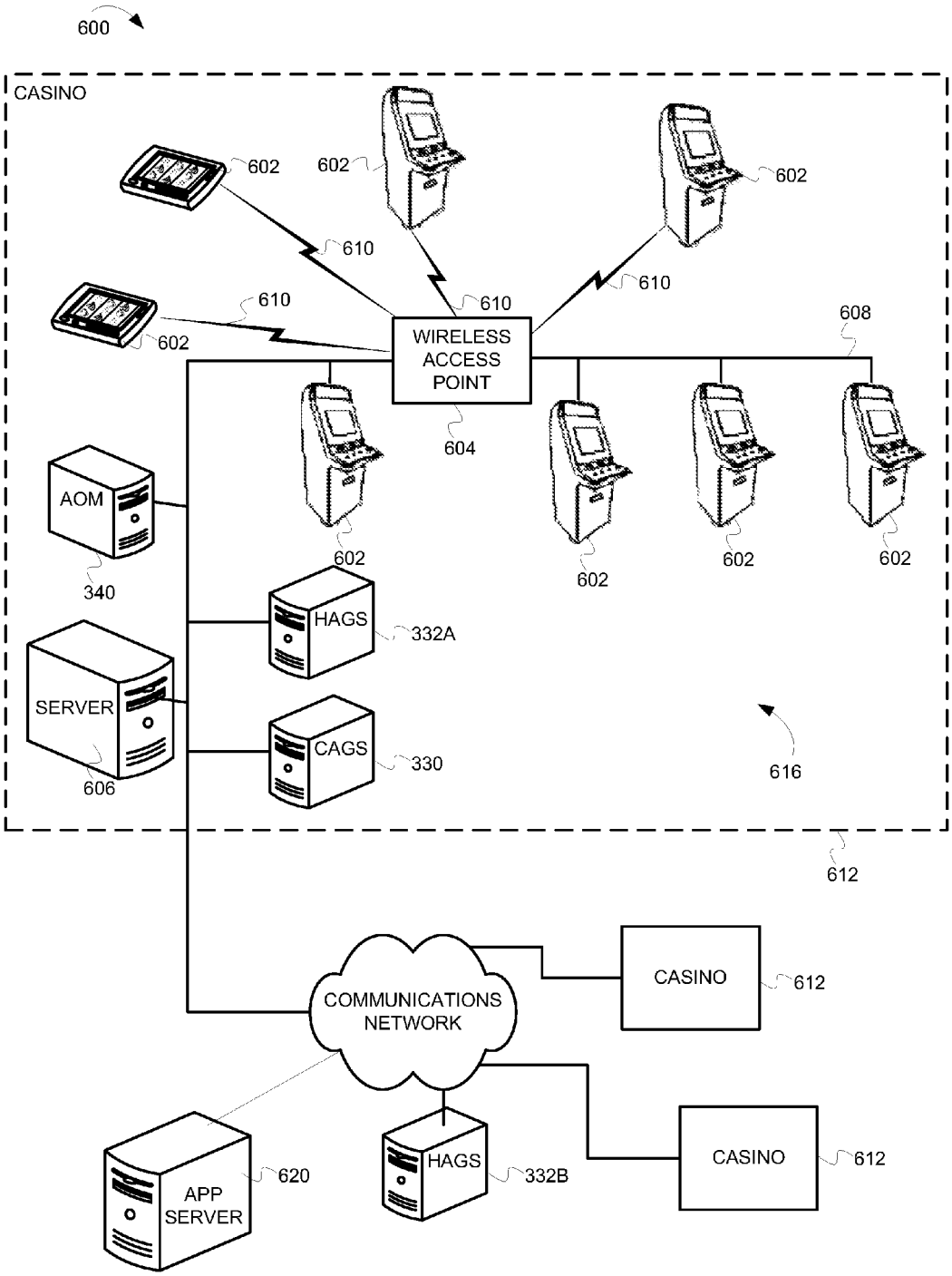
FIG. 6 depicts an example wagering game network, as may be utilized with a wagering game assembly as described herein.

While FIGS. 4 and 5 describe example embodiments of a wagering game machine architecture, FIG. 6 shows how a plurality of wagering game machines can be connected in a wagering game network 600, according to example embodiments of the invention. As shown in FIG. 6, the example wagering game network 600 includes not only a plurality of wagering game machines that may within a casino, but may also include multiple casinos 612 connected to a communications network 614.

Each of the plurality of casinos 612 includes a local area network 616, which may include a wireless access point 604, wagering game machines 602, and in some examples, a wagering game server 606 that can serve wagering games over the local area network 616. As such, the local area network 616 includes wireless communication links 610 and wired communication links 608. The wired and wireless communication links can employ any suitable connection technology, such as Bluetooth, 802.11, Ethernet, public switched telephone networks, SONET, etc. In one embodiment, the wagering game server 606 can serve wagering games and/or distribute content to devices located in other casinos 612 or at other locations on the communications network 614.

The wagering game machines 602 and servers 330, 332, 606 and 620 can include hardware and machine-readable media including instructions for performing the operations described herein.

The wagering game machines 602 described herein can take any suitable form, such as floor standing models, handheld mobile units, bartop models, workstation-type console models, etc. Further, the wagering game machines 602 can be primarily dedicated for use in conducting wagering games, or can include non-dedicated devices, such as mobile phones, personal digital assistants, personal computers, etc. In one embodiment, the wagering game network 600 can include other network devices, such as accounting servers, wide area progressive servers, player tracking servers, and/or other devices suitable for use in connection with embodiments of the invention.

In various embodiments, wagering game machines 602 and wagering game servers 620 work together such that a wagering game machine 602 may be operated as a thin, thick, or intermediate client. For example, one or more elements of game play may be controlled by the wagering game machine 602 (client) or the wagering game server 606 (server). Game play elements may include executable game code, lookup tables, configuration files, game outcome, audio or visual representations of the game, game assets or the like. In a thin-client example, the wagering game server 606 may perform functions such as determining game outcome or managing assets, while the wagering game machine 602 may be used merely to present the graphical representation of such outcome or asset modification to the user (e.g., player). In a thick-client example, game outcome may be determined locally (e.g., at the wagering game machine 602) and then communicated to the wagering game server 606 for recording or managing a player's account.

Similarly, functionality not directly related to game play may be controlled by the wagering game machine 602 (client) or the wagering game server 606 (server) in embodiments. For example, power conservation controls that manage a display screen's light intensity may be managed centrally (e.g., by the wagering game server 606) or locally (e.g., by the wagering game machine 602). Other functionality not directly related to game play may include presentation of advertising, software or firmware updates, system quality or security checks, etc.

Application server 620 may provide access to applications, including web based applications, that allow a user to play casual games (i.e., non-wagering based games) that have themes or play mechanics that are the same or similar to wagering games presented in a gaming establishment. As discussed above, achievement levels or virtual tokens earned during the play of such casual games may be integrated with game play in an associated wagering game. An example of such a web site provide these web applications is located at the URL www.playerslife.com operated by WMS Gaming Inc.

General

In this detailed description, reference is made to specific examples by way of drawings and illustrations. These examples are described in sufficient detail to enable those skilled in the art to practice the inventive subject matter, and serve to illustrate how the inventive subject matter can be applied to various purposes or embodiments. Other embodiments are included within the inventive subject matter, as logical, mechanical, electrical, and other changes can be made to the example embodiments described herein. Features or limitations of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims.

Each of the embodiments described herein are contemplated as falling within the inventive subject matter, which is set forth in the following claims.

What is claimed is:

1. A wagering game system primarily dedicated to conducting a casino wagering game, the wagering game system comprising:

a casino game server requiring login credentials for accessing a service provided by the casino game server;

an electronic random element generator configured to generate one or more random elements associated with determining outcomes of the casino wagering game;

a wagering game machine having:

a gaming cabinet housing electronic components operable for conducting the casino wagering game, an electronic input device coupled to the gaming cabinet and configured to receive a physical input from a player to initiate the wagering game and transform the physical input into an electronic data signal, one or more processors stowed inside the gaming cabinet, and at least one electronic display device coupled to the gaming cabinet and configured to display an outcome of the casino wagering game upon which monetary value may be wagered, the outcome being randomly determined based, at least in part, on at least one of the one or more random elements generated by the electronic random element generator;

a portal container providing a runtime environment for applications;

a login application for the portal container to: establish a communications stream with the server, receive the login credentials, and provide the login credentials to the server through the communications stream;

one or more portal applications for the portal container, the one or more portal applications utilizing the service provided by the server, the one or more portal applications being separate from the wagering game, the one or more portal applications authorized for the service using the login credentials provided to the login application through the communications stream; and wherein the login application multiplexes communications from the one or more portal applications to the server, through the communication stream established by the login application.

2. The wagering game system of claim 1, wherein the portal container includes an encryption module, and wherein at least a portion of the login credentials are encrypted using the encryption module.

3. The wagering game system of claim 2, wherein the encryption module implements AES (Advance Encryption Standard) encryption.

4. The wagering game system of claim 1, wherein the one or more portal applications include one or more games provided in addition to the wagering game upon which monetary value may be wagered.

5. The wagering game system of claim 1, wherein the one or more portal applications include one or more of: an advertising application, a messaging application, a service reservation application, an email application, a web browser application, or an information provider application.

6. A method of operating a wagering game system primarily dedicated to conducting casino wagering games, the wagering game system having one or more electronic input devices configured to receive physical inputs from players and transform the physical inputs into electronic data signals, one or more electronic display devices configured to display outcomes of wagering games, one or more casino game servers with one or more electronic random element generators configured to generate random elements associated with play of wagering games, the method comprising:

receiving, via at least one of the one or more electronic input devices, a physical input from a player as an indication of a wager to play a wagering game;

initializing, in response to an electronic data signal generated by the at least one electronic input device responsive to the physical input from the player, presentation of the wagering game upon which monetary value may be wagered;

randomly determining, based, at least in part, on one or more random elements generated by at least one of the one or more electronic random element generators, an outcome of the wagering game from a plurality of available wagering-game outcomes;

displaying, via at least one of the one or more electronic display devices, the randomly determined outcome of the wagering game;

initializing a portal container, a login application, and one or more portal applications, the login application and the one or more portal applications running within a runtime environment provided by the portal container, the one or more portal applications being separate from the wagering game;

receiving, by the login application, login credentials for accessing one or more services provided by at least one of the one or more casino game servers;

establishing, by the login application, a communications stream with the one or more casino game servers;

providing, by the login application, the login credentials to the one or more casino game servers through the communications stream;

utilizing, by the one or more portal applications, the login credentials provided by the login application to access services provided by the one or more casino game servers, the one or more portal applications authorized using the login credentials provided to the login application; and utilizing the communication stream established by the login application to communicate transactions between the one or more portal applications and the one or more casino game servers.

7. The method of claim 6, wherein receiving the login credentials includes receiving a user identification and password.

8. The method of claim 6, wherein receiving the login credentials includes receiving a user identification from a player tracking system upon insertion of a player tracking card.

9. The method of claim 6, wherein a portal application of the one or more portal applications uses the login credentials to access a player profile maintained on the server.

10. The method of claim 9, wherein the player profile includes achievement levels for an online casual game, and wherein the portal application presents the casual game.

11. The method of claim 6, wherein a portal application of the one or more portal applications users the login credentials to access a message server.

12. A method of operating a wagering system for conducting a wagering game, the wagering game system having an electronic input device configured to receive a physical input from a player and transform the physical input into an electronic data signal, an electronic display device configured to display the wagering game, a casino game server and an electronic random element generator configured to generate a random element associated with play of the wagering game, the method comprising:

receiving, via the electronic input device, the physical input from the player as an indication of a wager to play the wagering game;

initializing, in response to the electronic data signal generated by the electronic input device responsive to the physical input from the player, presentation of the wagering game upon which monetary value may be wagered;

randomly determining, based, at least in part, on the random element generated by the electronic random element generator, an outcome of the wagering game from a plurality of available wagering-game outcomes;

displaying, via the electronic display device, the randomly determined outcome of the wagering game;

initializing a portal container and one or more portal applications, the one or more portal applications running within a runtime environment provided by the portal container, the one or more portal applications existing separately from the wagering game;

registering, by the one or more portal applications, with the portal container;

receiving, by a portal application of the one or more portal applications, a set of events supported by the portal container;

subscribing, by the portal application, to a subset of the set of events; and notifying the portal application by the portal container upon occurrence of an event in the subset of the set of the events.

13. The method of claim 12, wherein the event comprises a login event.

14. The method of claim 6, wherein initializing a portal container and one or more portal applications comprises reading a configuration that specifies the login application to be loaded and the one or more portal applications to load.

15. The method of claim 6, further comprising concurrently presenting the one or more portal applications and the wagering game in separate windows.

16. The method of claim 12, wherein the event comprises insertion or removal of a player identification card.

17. The method of claim 12, wherein the event comprises an event in a community based game.

18. The method of claim 17, wherein the event in the community based game includes one or more of a game level achievement, a game trophy, or a game milestone.

19. A non-transitory machine-readable medium having stored thereon instructions for causing one or more processors of a wagering game system primarily dedicated to conducting casino wagering games to perform operations comprising:

receiving, from at least one of one or more electronic input devices, a physical input from a player as an indication of a wager to play a wagering game;

initializing, in response to an electronic data signal generated by the at least one electronic input device responsive to the physical input from the player, presentation of the wagering game upon which monetary value may be wagered;

randomly determining, based, at least in part, on one or more random elements generated by at least one of one or more electronic random element generators, an outcome of the wagering game;

displaying, via at least one of one or more electronic display devices, the randomly determined outcome of the wagering game;

initializing a portal container, a login application, and one or more portal applications, the login application and the one or more portal applications running within a runtime environment provided by the portal container, the one or more portal applications displayed separately from the presentation of the wagering game;

receiving, by the login application, login credentials for accessing one or more services provided by at least one of one or more casino game servers;

establishing, by the login application, a communications stream with the one or more casino game servers;

providing, by the login application, the login credentials to the one or more casino game servers through the communications stream;

utilizing, by the one or more portal applications, the login credentials provided by the login application to access services provided by the one or more casino game servers, the one or more portal applications authorized using the login credentials provided to the login application; and multiplexing communications from the one or more portal applications to the one or more casino game servers, through the communication stream established by the login application.

20. The machine-readable medium of claim 19, wherein receiving the login credentials includes receiving a user identification and password.

21. The machine-readable medium of claim 19, wherein receiving the login credentials includes receiving a user identification from a player tracking system upon insertion of a player tracking card.

22. The machine-readable medium of claim 19, wherein a portal application of the one or more portal applications uses the login credentials to access a player profile maintained on the server.

23. The machine-readable medium of claim 22, wherein the player profile includes achievement levels for an online casual game, and wherein the portal application presents the casual game.

24. The machine-readable medium of claim 19, wherein a portal application of the one or more portal applications users the login credentials to access a message server.

25. A non-transitory machine-readable medium having stored thereon instructions for causing one or more processors of a wagering game system for conducting a wagering game to perform operations comprising:

receiving, via an electronic input device, a physical input from a player as an indication of a wager to play the wagering game;

initializing, in response to an electronic data signal generated by the electronic input device responsive to the physical input from the player, presentation of the wagering game upon which monetary value may be wagered;

randomly determining, based, at least in part, on a random element generated by an electronic random element generator, an outcome of the wagering game from a plurality of available wagering-game outcomes;

displaying, via an electronic display device, the randomly determined outcome of the wagering game;

initializing a portal container and one or more portal applications, the one or more portal applications running within a runtime environment provided by the portal container, the one or more portal applications existing separately from the wagering game;

registering, by the one or more portal applications, with the portal container;

receiving, by a portal application of the one or more portal applications, a set of events supported by the portal container;

subscribing, by the portal application, to a subset of the set of events; and notifying the portal application by the portal container upon occurrence of an event in the subset of the set of the events.

26. The machine-readable medium of claim 25, wherein the event comprises a login event.

27. The machine-readable medium of claim 25, wherein the event comprises insertion or removal of a player identification card.

28. The machine-readable medium of claim 25, wherein the event comprises an event in a community based game.

29. The machine-readable medium of claim 28, wherein the event in the community based game includes one or more of a game level achievement, a game trophy, or a game milestone.

* * * * *